US011255122B2

(12) United States Patent
Miller

(10) Patent No.: US 11,255,122 B2
(45) Date of Patent: Feb. 22, 2022

(54) CHILD SAFETY BARRIER SYSTEM

(71) Applicant: Victor Miller, Winter Garden, FL (US)

(72) Inventor: Victor Miller, Winter Garden, FL (US)

( * ) Notice: Subject to any disclaimer, the term of this patent is extended or adjusted under 35 U.S.C. 154(b) by 0 days.

(21) Appl. No.: 16/829,931

(22) Filed: Mar. 25, 2020

(65) Prior Publication Data

US 2021/0301589 A1 Sep. 30, 2021

(51) Int. Cl.

*E06B 9/06* (2006.01)
*E06B 9/04* (2006.01)
*E06B 9/00* (2006.01)

(52) U.S. Cl.

CPC ..... *E06B 9/0638* (2013.01); *E06B 9/04* (2013.01); *E06B 9/0692* (2013.01); *E06B 2009/002* (2013.01)

(58) Field of Classification Search

CPC ..... E06B 2009/002; E06B 9/04; E06B 9/02; E06B 7/32; E06B 11/02; E05B 65/0007; E05B 65/0014; A01K 1/0017; E05Y 2900/40

See application file for complete search history.

(56) References Cited

U.S. PATENT DOCUMENTS 4,984,619 A * 1/1991 Ellis ..... E06B 9/01 160/351
5,906,068 A * 5/1999 Bode ..... E06B 9/02 49/55
6,176,042 B1 * 1/2001 Rossman ..... A01K 1/0017 160/210
6,532,703 B1 * 3/2003 Barrens ..... E06B 7/02 160/215
7,314,078 B2 * 1/2008 Melino, Jr ..... E04G 21/30 160/368.1
7,717,382 B2 * 5/2010 Whittemore ..... F16M 13/027 248/230.4
7,887,029 B2 * 2/2011 Flannery ..... E06B 9/06 256/73
7,979,960 B2 7/2011 Sano et al.
8,528,257 B2 * 9/2013 Kobayashi ..... A01K 1/035 49/463
9,689,197 B1 * 6/2017 Flannery ..... E05B 17/2069
9,826,710 B1 * 11/2017 McNew ..... A01K 1/0017
2008/0185566 A1 * 8/2008 Flannery ..... E06B 9/06 256/73
2010/0293861 A1 * 11/2010 Ting ..... E05B 63/0052 49/394
2011/0067309 A1 * 3/2011 Hofmann ..... E06B 9/04 49/55
2017/0350165 A1 * 12/2017 Schort ..... E05B 65/0014

* cited by examiner

*Primary Examiner* — Justin B Rephann
(74) *Attorney, Agent, or Firm* — Jason T. Daniel, Esq.; Daniel Law Offices, P.A.

(57) ABSTRACT

A child safety barrier system includes a plurality of elongated panel sections having a predetermined height and width. At least one support joint is connected between two of the plurality of panel sections to support the plurality of panels in a freestanding vertical orientation to form a panel assembly. A pair of telescoping anchors are positioned along each end of the panel assembly. Each of the telescoping anchors including a header assembly along the top end having an omnidirectional joint for positioning a malleable header block against the ceiling of a building in a plurality of different orientations.

13 Claims, 3 Drawing Sheets

CHILD SAFETY BARRIER SYSTEM

TECHNICAL FIELD

The present invention relates generally temporary barriers and more particularly to a child safety barrier system.

BACKGROUND

The statements in this section merely provide background information related to the present disclosure and may not constitute prior art.

Safety barriers for pets and children function as a barrier to prevent children and pets from crossing a threshold such as a hallway or doorframe, for example. In this regard, they are used to isolate specific rooms or entire sections of a structure. Such systems typically include an elongated member that can expand longitudinally so as to be compressed between two walls or may include a hinge mechanism allowing the member to swing between an open and closed position.

Although these systems are extremely popular and function well for their intended use within limited narrow accessways, they are not suited for use in wide open areas where two walls are not accessible.

Accordingly, it would be beneficial to provide a safety barrier system having a plurality of telescoping supports that do not engage a wall or other vertical structure so as to allow users to establish a secure-fixed barrier zone at any location within a home or building.

SUMMARY OF THE INVENTION

The present invention is directed to a child safety barrier system. One embodiment of the present invention can include a plurality of elongated panel sections having a specific height and width. The system can also include at least one support joint that is positioned between two of the plurality of panel sections. The support joint can function to support the plurality of panels in a freestanding vertical orientation to form a panel assembly. A pair of telescoping anchors can be positioned along each end of the panel assembly and can selectively anchor the panel assembly in place.

In one embodiment of the invention, each of the telescoping anchors can include a header assembly along the top end. The header assembly can include an omnidirectional joint for positioning a malleable header block against a ceiling in a plurality of different orientations.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Definitions

As described herein, the term "removably secured," and derivatives thereof shall be used to describe a situation wherein two or more objects are joined together in a non-permanent manner so as to allow the same objects to be repeatedly joined and separated.

As described throughout this document, the term "complementary shape," and "complementary dimension," shall be used to describe a shape and size of a component that is identical to or substantially identical to the shape and size of another identified component within a tolerance such as, for example, manufacturing tolerances, measurement tolerances or the like.

As described herein, the terms "connector" and "complementary connector" include any number of different elements that work together to repeatedly join two items together in a nonpermanent manner. Several nonlimiting examples include opposing strips of hook and loop material (i.e. Velcro®), attractively-oriented magnetic elements, flexible strips of interlocking projections with a slider (i.e., zipper), tethers, buckles such as side release buckles, and compression fittings such as T-handle rubber draw latches, hooks, snaps and buttons, for example. Each illustrated connector and complementary connector can be permanently secured to the illustrated portion of the device via a permanent sealer such as glue, adhesive tape, or stitching, for example.

As described herein, the term "pivotally connected" and derivatives thereof shall be used interchangeably to describe a situation wherein two identified objects are joined together in a manner that allows one or both of the objects to pivot, and/or rotate about or in relation to the other object in one or both of a horizontal or vertical manner. Several nonlimiting examples include hinge mechanisms, ball joint couplers, swivel flanges, and dual axis hinges such as that described in U.S. Pat. No. 7,979,960, the contents of which are incorporated herein by reference.

Figure 1:
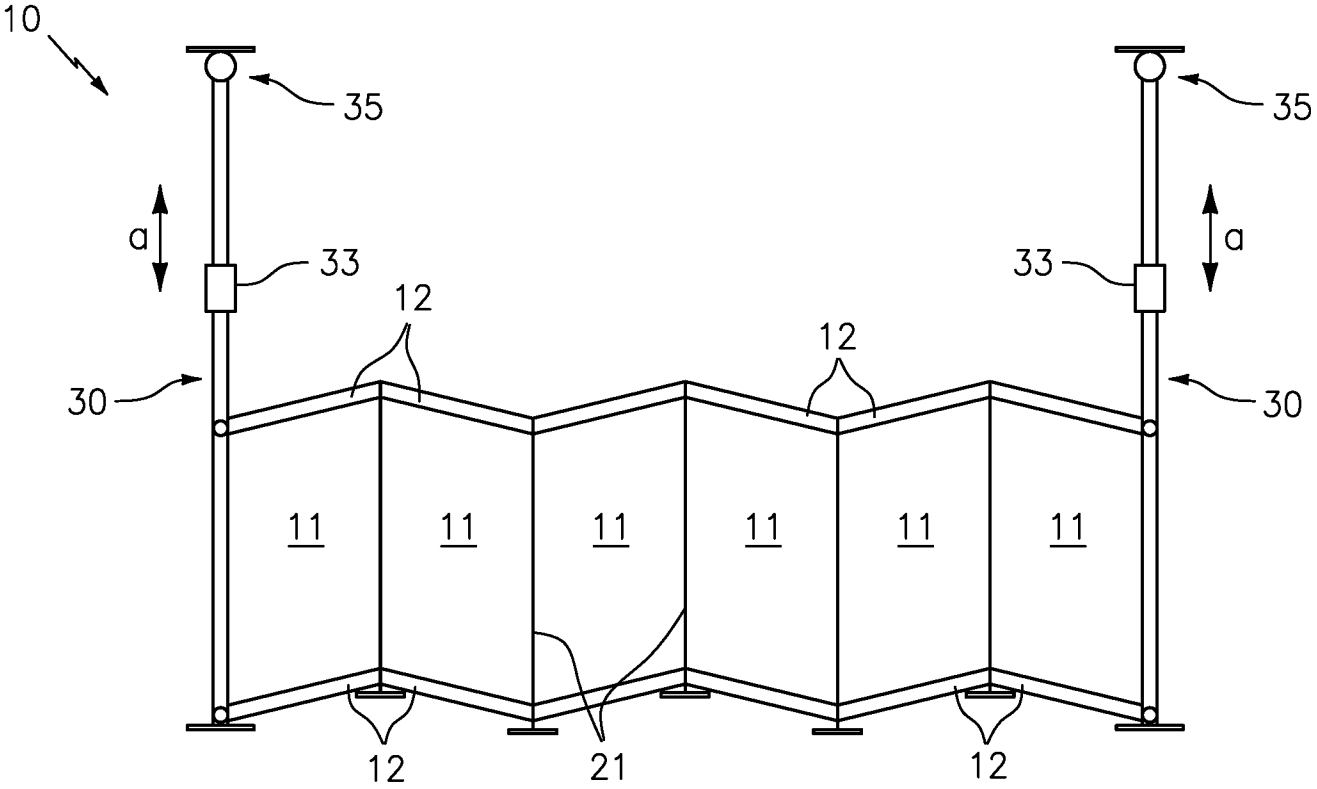
FIG. 1 is a perspective view of a child safety barrier system that is useful for understanding the inventive concepts disclosed herein.
Figure 2:
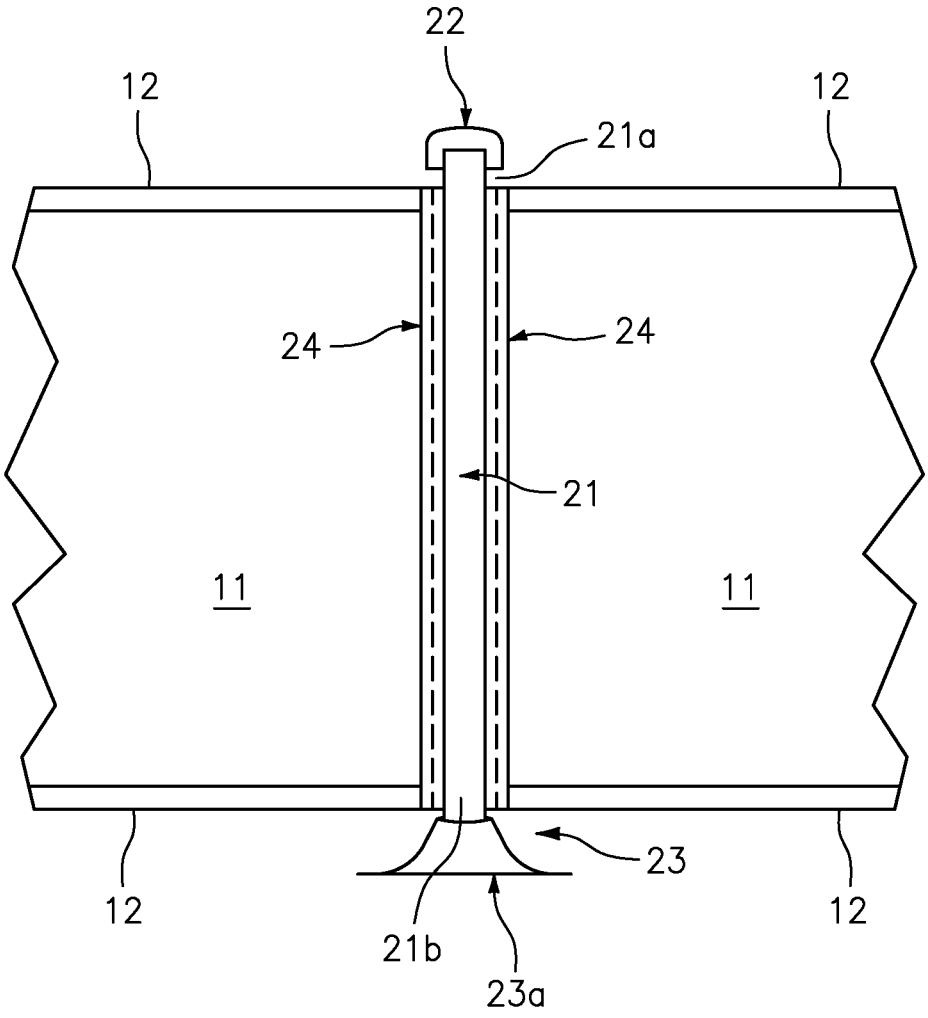
FIG. 2 is a cutout view of the child safety barrier system of FIG. 1, in accordance with one embodiment of the invention.
Figure 3:
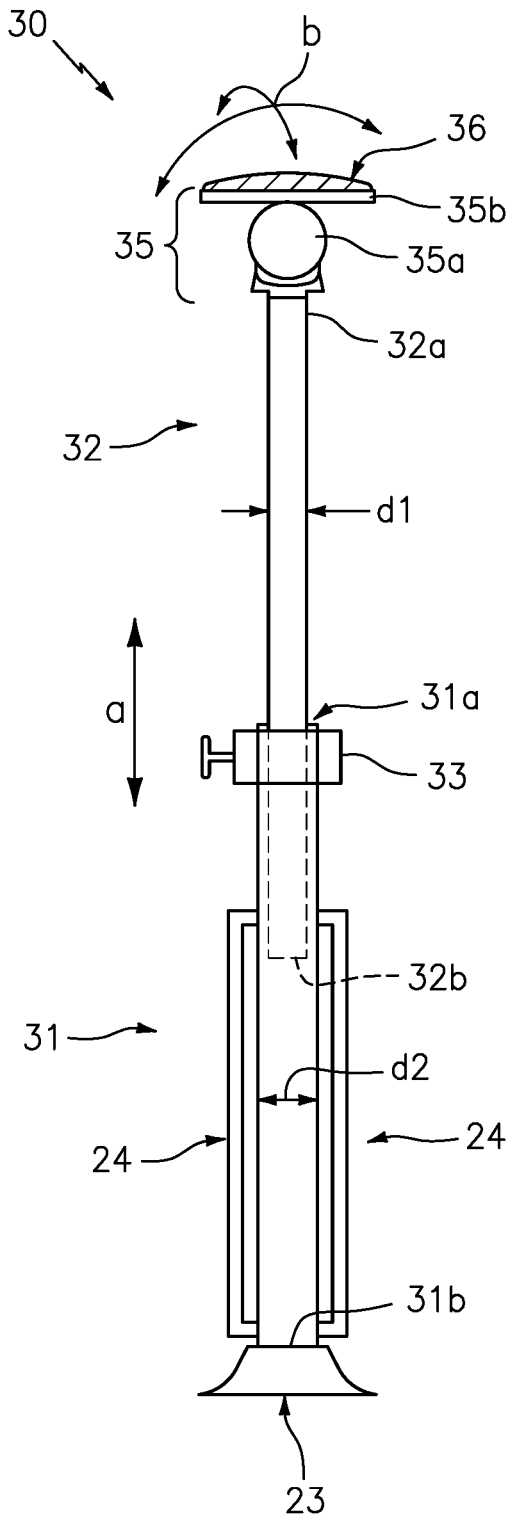
FIG. 3 is a side view of a telescoping anchor of the child safety barrier system, in accordance with one embodiment of the invention.

FIGS. 1-3 illustrate one embodiment of a child safety barrier system 10 that are useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

As shown in FIG. 1, the system 10 can include a plurality of panel sections 11, one or more support joints 21 that are positioned between the panel sections, and a plurality of telescoping anchors 30 that are positioned along both ends of the panel assembly.

As described herein, each of the panel sections 11 can function to provide a physical barrier for preventing passage by a child, animal or other intended user. To this end, each of the panel sections can be constructed to include any number of different heights and widths, depending on the intended use of the resulting system.

In the preferred embodiment, each of the panel sections 11 can be constructed from a generally malleable material such as nylon mesh netting, for example, and can include a layer of reinforced nylon 12 that is stitched or otherwise secured along the outer edges of the panels. As is known in the art, mesh netting has inherently high tensile strength and is known to be extremely durable and lightweight. Additionally, the use of such a material allows the system to be easily collapsed and stored so as to occupy minimal space when not in use.

Although described above as including malleable panel sections, this is for illustrative purposes only, as any number of other construction materials are also contemplated. For example, in one embodiment, one or more of the panel sections 11 can be constructed from a generally rigid and/or self-supporting material such as plastic, for example. In such an embodiment, the panel sections may preferably include a generally transparent construction and/or may include a plurality of apertures so as to provide a caregiver with a clear view through the panel sections.

As shown at FIG. 2, each of the support joints 21 can function to provide support for positioning and maintaining each of the panels 11 in a vertical and stationary position when deployed. To this end, each of the support joints 21 can comprise an elongated rigid pole having a top end 21*a* and a bottom end 21*b*.

As described herein, each of the support joints 21 may be formed from materials that are, for example, relatively strong and stiff for their weight. Several nonlimiting examples include, but are not limited to various metals or metal alloys (e.g., aluminum, steel, titanium, or alloys thereof), plastic/polymers (e.g., high-density polyethylene (HDPE), rigid polyvinyl chloride (PVC), or polyethylene terephthalate (PET)), and/or various composite materials.

In one embodiment, a generally blunt cap 22 can be positioned along the top end of each of the support joints. The blunt caps preferably being constructed from a soft material (e.g., non-rigid and malleable in nature) such as rubber, for example, and functioning to prevent injuries to a child or animal who may grab the same. Of course, any number of other construction materials are also contemplated.

In one embodiment, a footer 23 can be secured along the bottom end of each of the support joints. The footer including an outside diameter that is greater than that of the support joint and functioning to allow the support joint to stand upright. In various embodiments, an internal weight may be positioned within the footer, and a high friction material 23*a* such as nonskid rubber, for example may be placed along the bottom of the footer to prevent movement.

As shown, two generally C-shaped channels 24 can be disposed along the support joint for receiving the sides of the adjacent panels 11. The panels may therefore be secured within the channels using known construction methodologies via the use of internal glue or resin, or through the use of any number of connectors such as compression fittings and the like. In either instance, the C-shaped channels function to secure the entire side of a panel 11 along the entire side of a support joint 21 in a manner that allows the panels to pivot/move while preventing separation of the panels from the joint.

Of course, other embodiments are contemplated wherein other devices for securing the panels to the support joints are contemplated.

FIG. 3 Illustrates one embodiment of a telescoping anchor 30, which can function to engage both a floor and ceiling so as to immobilize the system during use. As shown, the anchor 30 can include an elongated, generally hollow lower pole member 31 having an open top end 31*a*, and a closed bottom end 31*b*. The lower pole member can also include the above described footer 23 and C-shaped channels 24.

The anchor 30 can also include an elongated upper pole member 32 having a bottom end 32*b* and a top end 32*a* onto which an adjustable header assembly 35 is secured. As described herein, each of the upper pole member and the lower pole member can include any number of different lengths so as to be suitable for engaging ceilings of varying heights. Also, each of the pole members will preferably be constructed from an identical material as the above described support joints, but other construction materials are also contemplated.

In the preferred embodiment, the upper pole section can include an outside diameter d1 that is less than an inside diameter d2 of the lower pole section so as to be positionable through the open top end 31*a* in a telescopic manner (see arrow a). In this regard, a tensioning claim 33 can be positioned where the pole members meet and can function to impart a clamping force onto the poles so as to selectively prevent movement of the same.

The header assembly 35 can function to engage an overhead structure such as a ceiling, for example, that is disposed at virtually any angle. As such, the header 35 can preferably include a dual axis joint 35*a* for pivotally positioning the header block 35*b* omnidirectionally (see arrow b).

As described herein, the header block 35*b* can preferably be constructed from a semi-resilient material such as bendable plastic, for example, and can include a large cross sectional dimension (e.g., one that is at least four times greater than the cross-sectional dimensions of the upper pole member). The large dimension being chosen specifically to spread out the area for which the force applied by the pole engages a ceiling. In one embodiment, padding 36, such as closed cell foam, for example, can be positioned along the entire upper surface of the block and can further attempt to cushion the force applied onto the ceiling so as to reduce the likelihood of causing damage to the drywall ceiling.

In operation, the system 10 can be positioned at any location within a structure using the anchors 30 to establish the boundaries of the protective panels. To this end, a user can first position one of the anchors 30 at a first location and can then extend the upper pole member until the header block is firmly engaged to the ceiling.

As noted above, the dual axis joint will allow the header to move so that the padded upper surface is flush with the ceiling regardless of the ceiling's orientation. Once positioned, the user can use the clasp to lock the length of the anchor and to secure the same in place. Next, the user can position the panels 11 in any desired configuration and can then secure the other anchor in the same manner described above.

As previously noted, the system 10 can be constructed to include any number of different lengths, therefore any number of individual panels 11, joints 21 and/or anchors 30 can be provided. Moreover, each of these components may be removably connected to the system so as to allow an end user to expand an existing system with additional panels, joints and/or anchors over time.

As described herein, one or more elements of the child safety barrier system 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individually identified elements may be formed together as one or more continuous elements, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the terms "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. A barrier system, comprising:

a plurality of panel sections;

at least one support joint that is positioned between two of the plurality of panel sections;

each of the at least one support joint including a non-rigid blunt cap that is positioned along a top end thereof;

a pair of telescoping anchors, each of the telescoping anchors being positioned along a distal end of one of the plurality of panel sections;

a pair of header assemblies that are positioned along a top end of the pair of telescoping members, each of the header assemblies including an omnidirectional joint and a header block, wherein the header block of each of the header assemblies includes an outside diameter that is at least four times greater than an outside diameter of the telescoping anchor, and are configured to selectively and compressively engage a ceiling of a building in which the system is positioned.

2. The system of claim 1, wherein each of the telescoping anchors comprise:

a lower pole member having an open top end and a hollow interior space; and an upper pole member having a top end and bottom end, wherein the bottom end of the upper pole member is slidingly positioned within the open top end of the lower pole member.

3. The system of claim 2, further comprising:

a tensioning clamp that is positioned between the upper pole member and the lower pole member, said tensioning clamp functioning to selectively permit movement of the upper pole member relative to the lower pole member.

4. The system of claim 1, further comprising:

padding that is disposed along a top surface of the elongated header block.

5. The system of claim 1, wherein each of the at least one support joint comprises an elongated pole having a top end and a bottom end, and wherein said elongated pole includes a height that is less than a height of the telescoping anchors.

6. The system of claim 5, further comprising:

a footer that is positioned along the bottom end of the elongated pole, said footer functioning to position the elongated pole in a freestanding vertical orientation.

7. The system of claim 6, further comprising:

a weight that is positioned along an inside portion of the footer.

8. The system of claim 7, further comprising:

a high friction and non-skid material that is positioned along a bottom surface of the footer.

9. The system of claim 5, wherein at least one of the plurality of panel sections are permanently secured along a length of the elongated pole.

10. The system of claim 1, wherein each of the panel sections are constructed from a malleable material.

11. The system of claim 1, wherein each of the panel sections are constructed from a rigid material.

12. The system of claim 1, wherein each of the at least one support joint includes a pair of elongated C-shaped channels extending from the top end to a bottom end, and wherein an entirety of one side of one of the plurality of panel sections is positioned within each of the elongated C-shaped channels.

13. The system of claim 1, wherein each of the pair of telescoping anchors includes a pair of elongated C-shaped channels, and wherein an entirety of one side of one of the plurality of panel sections is positioned within each of the elongated C-shaped channels.

* * * * *